US006374494B1

(12) United States Patent
Sonobe et al.

(10) Patent No.: US 6,374,494 B1
(45) Date of Patent: Apr. 23, 2002

(54) COMPOUND ROLL FOR THIN COLD ROLLED STEEL STRIP AND METHOD OF MANUFACTURING SAME

(75) Inventors: Osamu Sonobe; Hirotaka Kano; Kazuhito Kenmochi; Ikuo Yarita; Akihiko Fukuhara, all of Chiba; Nobuaki Gamo, Kanagawa, all of (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/180,672

(22) PCT Filed: Mar. 19, 1998

(86) PCT No.: PCT/JP98/01181

§ 371 Date: Nov. 13, 1998

§ 102(e) Date: Nov. 13, 1998

(87) PCT Pub. No.: WO98/42458

PCT Pub. Date: Oct. 1, 1998

(30) Foreign Application Priority Data

| | | |
|---|---|---|
| Mar. 21, 1997 | (JP) | 9-085553 |
| Mar. 25, 1997 | (JP) | 9-071936 |
| Mar. 27, 1997 | (JP) | 9-075096 |
| Apr. 3, 1997 | (JP) | 9-085032 |
| Jun. 17, 1997 | (JP) | 9-159477 |

(51) Int. Cl.[7] ..... B23P 15/00

(52) U.S. Cl. ..... 29/895.3; 29/895.213; 492/3; 492/58

(58) Field of Search ..... 492/3, 16, 54, 492/58; 29/895.213, 895.3, 895.2

(56) References Cited

U.S. PATENT DOCUMENTS

| | | | | |
|---|---|---|---|---|
| 4,000,010 A | * | 12/1976 | Sekimoto et al. | 492/3 |
| 4,606,883 A | * | 8/1986 | Wizemann et al. | 419/8 |
| 4,697,320 A | * | 10/1987 | Ishihara et al. | 492/3 |
| 4,756,180 A | * | 7/1988 | Miguchi et al. | 492/3 |
| 4,941,251 A | * | 7/1990 | Sobue et al. | 29/132 |
| 5,081,760 A | * | 1/1992 | Kikuhana et al. | 492/3 |
| 5,445,589 A | * | 8/1995 | Shimizu | 492/54 |
| 5,599,497 A | * | 2/1997 | Cordea et al. | 492/54 |
| 5,647,279 A | * | 7/1997 | Johner et al. | 492/54 |
| 5,813,962 A | * | 9/1998 | Kanayama et al. | 492/54 |
| 5,944,644 A | * | 8/1999 | Katayama et al. | 492/54 |

* cited by examiner

*Primary Examiner*—I Cuda Rosenbaum
(74) *Attorney, Agent, or Firm*—Young & Thompson

(57) ABSTRACT

The present invention provides a composite roll for cold rolling capable of rolling a cold-rolled steel strip having little edge drop, a cold-rolled stainless steel strip or a bright finish steel strip having excellent surface brightness or a silicon steel strip excellent in magnetic properties without causing breakage of roll, which is a roll in which a sleeve is fitted at a surrounding of a shaft portion with the shaft portion as a central axis and its fabrication method, in which the sleeve is constituted by previously integrating a plurality of pieces of mold members divided by a face intersecting with the central axis of the roll. Further, this is a fit roll in which a sleeve member of an outermost layer is made of WC—Co series hard alloys having Young's modulus of 35000 kgf/mm or more and Co content of 12–50 weight % and is provided with a wall thickness of 3% or more of roll radius and a ratio L/D of a length L of a barrel of the sleeve to a diameter D of the roll falls in a range of 2–10. Further, when there are one layer or more of intermediate layers between the outermost layer of the sleeve and the shaft core, the intermediate layers are arranged such that Young's modulus of the layer on the outer side is larger than Young's modulus of the layer on the inner side.

4 Claims, 7 Drawing Sheets

COMPOUND ROLL FOR THIN COLD ROLLED STEEL STRIP AND METHOD OF MANUFACTURING SAME

TECHNICAL FIELD

The present invention relates to a composite sleeve roll constituted by hard alloys having high hardness, high Young's modulus and high rigidity and its fabrication method. Further, the present invention relates to a roll for cold-rolling a cold-rolled steel strip such as a stainless steel strip, a silicon steel strip, a bright finish steel strip or the like and to a rolling roll capable of producing a cold-rolled steel strip having a small amount of edge drop, a cold-rolled stainless steel strip and a bright finish steel strip having excellent surface brightness and a silicon steel strip having excellent magnetic properties with high advantage.

BACKGROUND ART

In the production of steel strip, steel wire or rod steel, for example, Sendzimir mill roll, wire mill roll and the like are used and with requests for high grade formation of steel material to be handled, energy conservation and so on, rolls with a material of hard alloys having high hardness and high Young's modulus and excellent in wear resistance have been developed and used. These hard alloys rolls are mainly small-sized rolls having a comparatively small diameter, for example, a roll diameter of about 20 through 80 mm, or a roll diameter of 50 through 150 mm and a roll length of about 100 through 200 mm in accordance with a shape of material to be handled. In recent years, large size formation of hard alloys rolls has been requested in view of quality improvement of steel material and a necessity for long time period continuous operation for reducing production cost.

Generally, a monolithic body of hard alloys is used in a Sendzimir mill roll mentioned above and a wire mill roll or the like is fabricated by exerting compressive force in an axial direction to a shaft portion and a sleeve having an inner diameter substantially equivalent to a diameter of the shaft portion and surrounding the shaft portion as a central axis or exerting compressive force in a circumferential direction by a wedge type ring or the like to thereby fixing the sleeve onto the shaft portion and carrying out surface-finish treatment thereon.

However, according to the conventional method of fabricating a composite roll in which such a sleeve made of hard alloys is fitted to the shaft portion, in fabricating a large-sized roll (normally referring to a roll having a diameter of 150 mm or more and a length of 500 mm or more), the sleeve is fabricated by subjecting metal powder of hard alloys to rubber molding, sintering the metal powder as one piece hollow member having a hollow central shaft portion (with a diameter equivalent to the diameter of the shaft portion), subjecting the sintered body to hot isostatic press (HIP treatment) and thereafter machining the pressed body. Although the fabricated sleeve is fixed to the shaft portion, the hollow member is large-sized and is particularly made of the material of hard alloys and therefore, there cause frequently cases where large strain is generated in the material in subjecting the material to a heat treatment such as sintering or the like which makes difficult succeeding fabrication. Further, although in forming the hollow member by rubber molding, metal powder of hard alloys is packed sufficiently densely around a core rod having a diameter equivalent to that of the shaft portion and thereafter the core rod is drawn out to thereby form a mold body, when the hollow member is large-sized, the core rod is difficult to draw out and there pose frequently problems where the shape of the mold body is significantly deteriorated, a force more than necessary is needed and the like thereby causing difficulty in operational performance.

Next, an explanation will be given of a method of fabricating a cold-rolled stainless steel strip and a description will be given of problems in a method of fabricating stainless steel strip when large-sized rolls are used. Conventionally, a cold-rolled steel strip of stainless steel has been fabricated by the steps of annealing and pickling a hot-rolled strip, cold-rolling the hot-rolled strip by a Sendzimir mill or the like using a work roll made of a steel series alloy having a work roll diameter of 150 mmø or smaller, subjecting the cold-rolled material to finish annealing and pickling or finish bright annealing and rolling the annealed material by finish temper rolling with a reduction ratio of 1.2% or less. The cold-rolled stainless steel strip fabricated through these steps is frequently used with a surface thereof as fabricated in the case of a ferritic stainless steel represented by, for example, SUS 430 and excellent surface brightness is requested in a product after having been subjected to the finish temper rolling. Meanwhile, in the case of an austenitic stainless steel represented by SUS 304, buffing is frequently carried out after the finish temper rolling and excellent surface brightness needs to be shown after the buffing. In the meantime, in recent years, in order to efficiently fabricate the cold-rolled stainless steel strip, a method of continuous cold rolling in one direction by a tandem cold mill using large-sized work rolls of 150 mmØ or larger is being adopted. For example, Japanese Unexamined Patent Publication No. 8-39103 discloses a technology in which work rolls of WC series hard alloys are used in at least one stand in a tandem cold mill by which production efficiency is promoted and surface brightness of cold-rolled stainless steel strip is promoted. However, according to the method, there pose problems in which not only the surface brightness of the cold-rolled stainless steel strip has yet to reach a sufficient level but also the surface brightness is deteriorated with rolling time period or a work roll may be broken under certain circumstances. Further, there poses also a problem in which the cost per se of the roll is high.

Next, an explanation will be given of a method of producing a grain-oriented silicon steel strip and a description will be given of problems when the grain-oriented silicon steel strip is produced by using large-sized rolls. Conventionally, a cold-rolled steel strip of grain-oriented silicon steel has been fabricated by the steps of annealing and pickling a hot-rolled steel strip, successively cold-rolling the pickled strip by a tandem mill using high alloy steel work rolls by twice or more interposing intermediate annealings and thereafter subjecting the rolled strip to decarburization annealing and finish annealing. It is known that when the silicon steel strip fabricated through these steps is cold-rolled without removing scale after the intermediary annealings, the surface roughness of the steel strip is enlarged and adverse influence is effected on magnetic properties. Therefore, grinding is carried out by using a grinding belt after the intermediary annealing and before the successive cold-rolling. Further, the grain-oriented silicon steel strip is provided with extremely high deformation resistance since 2.5 through 4.0 wt % of Si is normally added and when the rolling is carried out under high load and high surface pressure, there pose problems in which the rolls are made eccentric, the cylindrical shape cannot be maintained, in respect of the shape of the steel strip, edge drop is particularly enlarged, trimming margins on both ends of strip are increased and the yield is deteriorated. Further, according to the conventional rolls, there pose problems in which not only the surface roughness of the grain-oriented silicon steel strip after cold-rolling has yet to reach a sufficient level but also the surface roughness is deteriorated with the rolling time period or the work roll may be destructed under certain circumstances. Further, there poses also a problem in which the cost per se of the roll is high.

Firstly, it is an object of the present invention to provide a method of fabricating a composite sleeve roll having no strain of material mentioned above with excellent operational performance when a composite sleeve roll having high hardness and high Young's modulus and excellent in wear resistance and long large-sized rolls are fabricated by using a material of hard alloys.

Further, there have been methods as technologies similar to portion of the present invention as disclosed in Japanese Examined Patent Publication No. 5-55202 and Japanese Unexamined Patent Publication No. 61-14104. However, Japanese Examined Patent Publication No. 5-55202 discloses a composite roll in which a sleeve produced by sintering powder of hard alloys or high speed steel at outside of a cylinder made of steel by high temperature hydrostatic molding by which the powder is subjected to diffusion bonding with the cylinder made of steel, and an arbor made of steel are fitted to each other, which is a roll for hot-rolling wire or rod steel and no mention is given to conditions for promoting surface brightness in cold rolling. Further, according to the disclosure in Japanese Unexamined Patent Publication No. 61-14104, although there has been disclosed a method in which a sleeve is molded by high temperature hydrostatic molding and a canning material on the inner side and the'sleeve are subjected to diffusion bonding by which the canning material is metallurgically bonded by middle build up process, the method is also in respect of a roll with an object of only improving wear resistance and skin roughening resistance and no proposal has been given of conditions of an outer layer portion of the roll constituting a rolling face and the like.

Hence, it is an object of the present invention to provide an inexpensive roll for cold rolling for resolving the above-described problems incorporated in the conventional technology and capable of further promoting the surface brightness of a cold-rolled stainless steel strip and a bright finish steel strip or the surface roughness of a silicon steel strip and stably rolling the above-mentioned cold-strips.

It is other object of the present invention to reduce edge drop of a cold-rolled steel strip, particularly to be able to achieve further promotion in the surface brightness of a cold-rolled stainless steel strip and a bright finish steel strip as well as the surface roughness of a silicon steel strip, to reduce a decrease in the surface brightness or the surface roughness even when rolling is carried out for a long period of time and to promote magnetic properties of the silicon steel strip. Further, it is other object thereof to provide an inexpensive roll for cold rolling without causing trouble such as breakage of roll or the like.

It is still another object of the present invention to provide a roll for cold rolling particularly achieving an effect by using the above-described respective features in a tandem cold mill.

Further, there have been proposed technologies similar to portions of the present invention in Japanese Examined Patent Publication No. 5-55202, Japanese Unexamined Patent Publication No. 4-41007 and Japanese Unexamined Patent Publication No. 60-111704. Further, a material having high Young's modulus is a brittle material such as ceramics or hard alloys and there is a concern that when stress is concentrated during rolling, destruction is caused from the place of stress concentration. Accordingly, it is important to prevent stress concentration in the material during rolling. The technology disclosed in Japanese Unexamined Patent Publication No. 4-41007 proposes a method of preventing the stress concentration. According to the method, ceramics or hard alloys is used in an outermost layer of a rolling roll and an intermediary material is arranged between the outermost layer and a core material with an effective elastic modulus of 3000 through 17000 $kgf/mm^2$ by means of fabricating grooves in a sawtooth shape in respect of oxygen free copper that is an elastoplastic material, winding the intermediary material in a form of a copper wire or the like. However, according to the rolling roll, when, a material for rolling having an extremely high deformation resistance as in, for example, a stainless steel strip or a silicon steel strip, is rolled under high load and high surface pressure, there is a concern in which the roll is made eccentric or the cylindrical shape cannot be maintained by plastic deformation of the intermediate layer and further, when the rolling continues the roll is destructed causing a serious problem.

Further, Japanese Unexamined Patent Publication No. 60-111704 has proposed a rolling roll which is a rolling roll having a roll barrel made of hard alloys and a roll neck made of steel and an intermediary material made of hard alloys having an amount of including a binder higher than that of the hard alloys of the roll barrel and having a higher strength, is provided between the roll barrel made of the hard alloys and the neck made of steel by soldering. However, no description has been given of the material of the hard alloys and further, a significant reduction in the cost in the case of fabricating a large-sized roll has not been resolved at all since a total of the roll barrel is constituted by the hard alloys.

Hence, it is an object of the present invention to resolve the above-described problems incorporated in the conventional technology and to provide a roll for cold rolling capable of further promoting the surface brightness of a cold-rolled stainless steel strip or a bright finish steel strip or to reduce the surface roughness of a silicon steel strip or to reduce edge drop and capable of stably rolling the cold-rolled steel strips such as the stainless steel strip, the silicon steel strip and so on.

It is other object of the present invention to provide an inexpensive roll for cold rolling capable of reducing edge drop of a cold-rolled steel strip, achieving further promotion in the surface brightness of particularly a cold-rolled stainless steel strip or a bright finish steel strip, or reducing the surface roughness and achieving further promotion in magnetic properties of a silicon steel strip without causing roll breakage or the like.

It is still further object of the present invention to provide a roll for cold rolling achieving an effect particularly when the above-described respective features are used in a tandem cold mill.

Further, generally, rolling oil is supplied as a lubricant between a steel strip and a roll in cold rolling of a steel strip. Therefore, a large amount of the rolling oil and metallic abrasive powder caused by friction between the roll and the steel strip in the rolling operation remain on the surface of the steel strip after rolling. When these are subjected to annealing at a succeeding step without cleaning them, the metal powder fixedly remains on the surface of the steel strip as it is or as it has been oxidized and nonuniformity of oil burn, oil stain or the like is caused on the surface of the steel strip whereby the surface quality of the steel strip is significantly deteriorated. Furthermore, when the nonuniformity is caused in a steel strip for an automobile or the like, partial exfoliation of deposit is caused in a succeeding plating step resulting in a failure in quality. Accordingly, there have been developed various technologies for cleaning the surface of the steel strip before the annealing step. For example, such a technology has been disclosed in Japanese Unexamined Patent Publication No. 60-261609, however, the technology is not yet sufficient. However, by carrying out cold rolling by using the roll of the present invention, that is, by using a WC series hard alloys which is difficult to adhere to a steel strip as the material of a rolling roll, occurrence of wear powder can be restrained, nonuniformity of the surface of the steel strip after annealing is not caused and a steel strip having surface cleanness more excellent than that in the conventional technology can be obtained.

DISCLOSURE OF THE INVENTION

The present invention relates to a composite sleeve roll and its fabrication method characterized in that it is a roll comprising a shaft portion and a sleeve having a hollow portion with an inner diameter substantially equivalent to a diameter the shaft portion and disposed at a surrounding the shaft portion in which the sleeve and the shaft portion are fixed to each other by inserting and fitting the shaft portion into the hollow portion and the sleeve is a sleeve constituted by previously integrating a plurality of pieces of formed body members divided by a face intersecting with the central axis of the roll.

Further, according to the present invention, in a composite roll for cold-rolling a stainless steel strip or a silicon steel strip in which a core member and a sleeve are fitted together, the core member comprises steel, a material of the sleeve comprises a WC—Co series hard alloys having Young's modulus of 35000 kgf/mm$^2$ or more and a Co content of 12 through 50 weight % and a wall thickness of the sleeve is formed to be 3% or more of a radius of the composite roll.

Further, according to the present invention, in respect of the above-mentioned invention, it is further specified that a ratio L/D of a length L of a barrel of the sleeve to a diameter D of the roll falls in a range of 2 through 10.

Further, according to the present invention, there is provided a composite roll for cold rolling in which a roll barrel comprises three or more of layers in shapes of concentric circles, an outermost layer is provided with Young's modulus of 35000 kgf/mm$^2$ or more and a thickness of the layer of 3% or more of a radius of the roll and an intermediate layer disposed between the outermost layer and a shaft core is provided with Young's modulus which is smaller than the Young's modulus of the outermost layer and larger than Young's modulus of the shaft core.

Further, according to the present invention, it is preferable that in respect of the above-mentioned invention, when the intermediate layer comprises two or more layers, materials of the intermediate layers are arranged such that the more relatively outer side the layer is disposed, the higher Young's modulus is provided to the material.

Further, according to the present invention it is preferable that all of the outermost layer and the intermediate layers comprise a WC series hard alloys and the composition of the hard alloys is constituted such that the more relatively outer side the layer is disposed, the smaller an equivalent bond amount of a binder metal is constituted.

BEST MODE FOR CARRYING OUT THE INVENTION

A further detailed explanation will successively be given of an embodiment of the present invention described in reference to the drawings.

Figure 1:
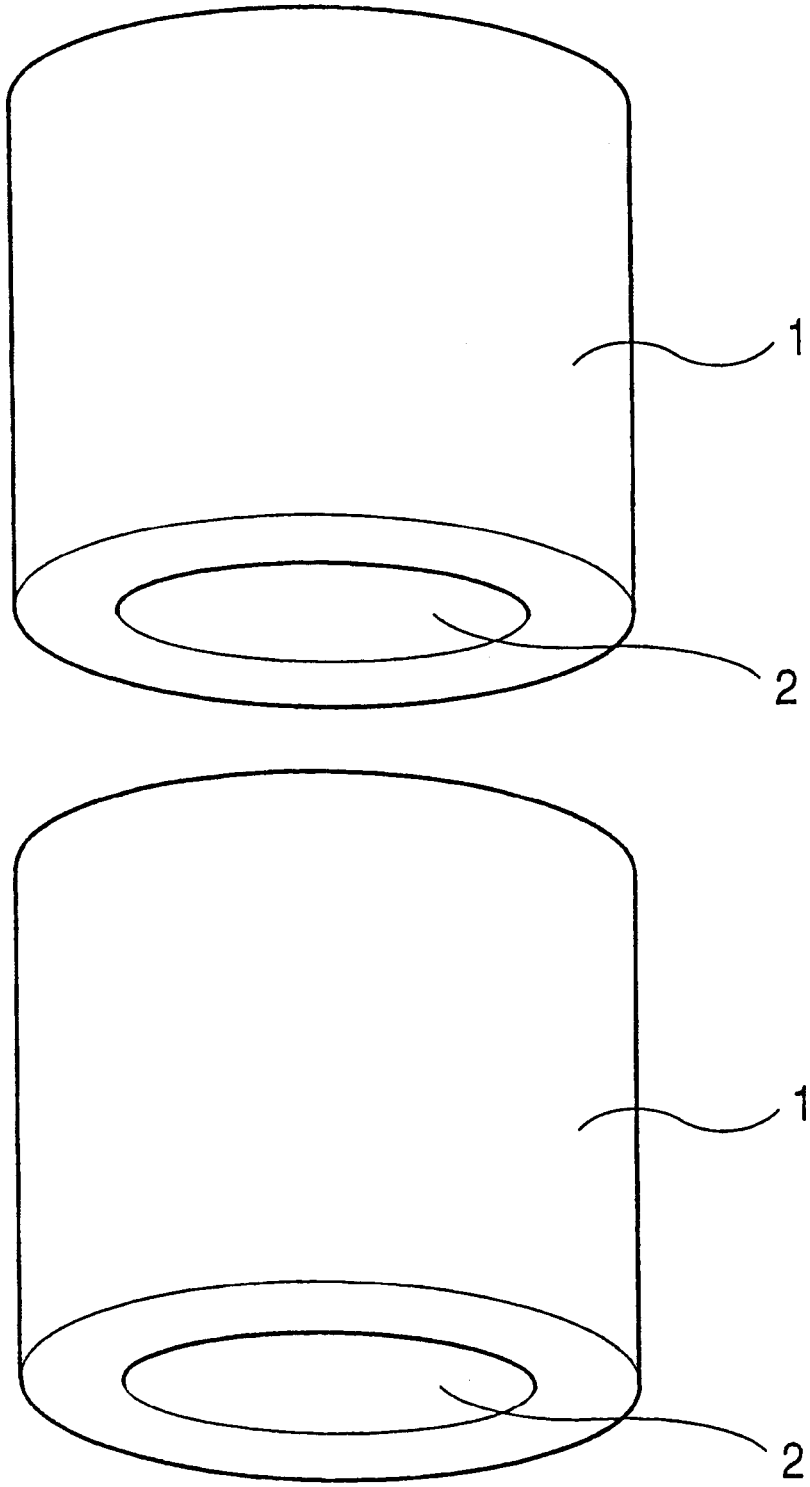
FIG. 1 is an exploded perspective view of two pieces of hollow members used in the present invention.
Figure 2:
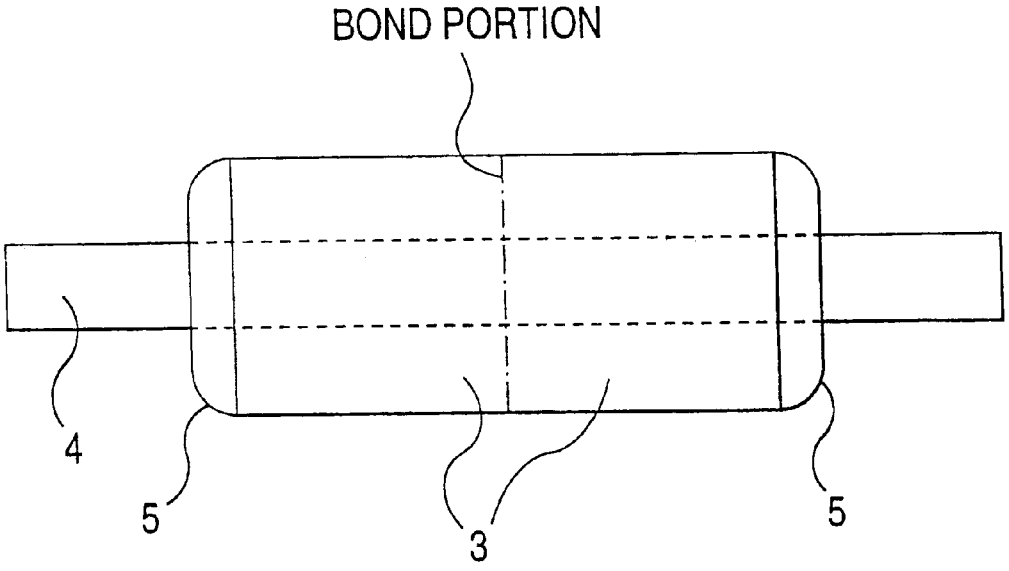
FIG. 2 is an explanatory view of a section cut along a central axis of a roll fabricated by the present invention.

FIG. 1 is an exploded perspective view of hollow members constituting a sleeve used in the present invention and FIG. 2 is a sectional view cut along a central axis of a roll fabricated by the present invention. In the drawings, numeral 1 designates a hollow member for constituting a sleeve, numeral 2 designates a cavity portion of the hollow member, numeral 3 designates an integrated sleeve, numeral 4 designates a shaft portion and numeral 5 designates a side end ring, respectively. The material of the roll used in the present invention is hard alloys powder comprising, for example, WC, TaC, TiC or the like.

According to the present invention, when a material having a grain size rougher than a hard alloys powder used as a material for a conventional tool or the like is used, a packing density is promoted in a molding step, mentioned later and a mold body having high wear resistance and-toughness can be formed. When WC is used for the material, a powder of WC, mixed with Co (Co: 5–50 wt %) is used and it is preferable to use, for example, WC powder and Co powder having a diameter of 1 through 2 $\mu$m by mixing them under an inert atmosphere by using media comprising the prepared material (balls made of WC). In constituting a mold body (notation 1 in the drawing) for constituting a hollow member by using powder of these hard alloys, a mold made of rubber, for example, a mold made of rubber which is constituted by double cylinders in pipe shapes comprising an outer cylinder having a predetermined diameter and an inner cylinder sharing a central axis of the outer cylinder in a depth (longitudinal) direction and having a diameter smaller than the diameter of the outer cylinder and which is constituted by a material having a thin wall and a material with high elongation and contraction strength, for example, rubber or the like, is used, in respect of the central axis of the inner cylinder in the longitudinal direction, a core rod having a diameter substantially equivalent to the inner diameter of the inner cylinder is inserted into the central axis portion by similarly aligning the central axes and the hard alloys powder of the material for the roll is packed into a space constituted by the inner wall of the outer cylinder and the outer wall of the inner cylinder to produce a sufficiently dense state by using, for example, a hammer type packing machine. The rubber mold used here is used in normal cold isostatic press (CIP treatment) molding, the size of which is determined by-the size of a product roll according to the present invention, which is constituted by, for example, an inner diameter of 200 through 600 mm of the outer cylinder of the double cylinders, an outer diameter of 100 through 500 mm of the inner cylinder and the depth (length in the longitudinal direction) of about 300 through 1500 mm and the rubber mold is featured in that it is more large-sized and longer than a sleeve of a roll constituted by conventional ultra hard material. Further, a rod, a hollow pipe or the like having a diameter substantially in correspondence with that of the shaft portion of the roll and comprising a material having high compressive strength is used for the core rod. It is preferable that the outer periphery of the rubber mold is protected and fixed by, for example, a metal vessel to maintain a constant shape in packing the powder. It is preferable to use a vessel having a number of through holes on its wall face or the like such that uniform pressure is applied on the surface of a mold body that is packed and molded in carrying out the CIP treatment in later steps. Further, in packing the hard alloys powder into the mold, a sufficiently dense mold body can be constituted without particularly using wax, stearic acid, camphor or the like as a lubricant used by being mixed into packing powder in the conventional CIP molding according to the present invention. After packing the hard alloys powder sufficiently densely, the core rod inserted into the central axis portion of the rubber mold is drawn out and a mold body of the rubber mold having a cavity portion (notation 2 in the drawing) at the central axis portion is constituted. The operation of drawing out the core rod is preferable in bringing the surface of the central axis portion (cavity portion) and the surface of the outer peripheral portion of the mold body into a uniform pressing state substantially in compliance with a similarity rule. The mold body from which the core rod has been drawn out and in which the central axis portion constitutes a cavity is directly subjected to the CIP molding and the conditions are preferably, for example, 1000 through 3000 kgf/mm$^2$ and 5 through 60 minutes. Although it is preferable to carry out the CIP treatment since the dimensional accuracy is improved and an amount of machining after preparatory sintering operation is reduced, it may not be carried out. Although the mold body obtained by the CIP treatment after having being processed through the steps described above, is excellent in dimensional accuracy and is provided as a mold body as designed, a deformation caused by its own weight of the mold body and a deformation by shrinkage due to heating or the like is conceivable in the later preparatory sintering step. Hence, it is preferable in the preparatory sintering to use a jig of, for example, a core member made of graphite in consideration of prevention of such a deformation. Further, it is further preferable to use a reaction preventive agent of, for example, boron nitride (BN) or the like by coating it on the surface of the jig in order to prevent unnecessary reaction at an interface where the jig and the mold body are brought into contact. The mold body which has been subjected to the CIP molding is subjected to the preparatory sintering. As preferable conditions, it is preferable in view of preventing the above-described deformation of the mold body to carry out the preparatory sintering in a vacuum furnace in which the mold body is heated in a state where the mold body is placed horizontally, that is, in a state where the central axis is substantially horizontal. As conditions of the preparatory sintering, for example, 550–800° C. and about 1–3 hours are preferable. The mold body which has been subjected to the preparatory sintering is excellent in dimensional accuracy and even when a predetermined shaping by, for example, a diamond bit, a lathe or the like is needed, the mold body is provided with a strength capable of sufficiently withstanding the working.

The present invention is characterized in that a sleeve constituted by an integrated mold body member or a sleeve integrated by bonding a plurality of pieces of mold bodies which have been subjected to preparatory sintering or preparatory sintering and shaping, is used and individual mold bodies are integrated by overlapping them in a state where central axes of faces intersecting with the central axes are aligned and by a method of press sintering or the like. In the case of the press sintering, pressing and sintering (regular sintering) may be carried out simultaneously or pressing may be carried out after regular sintering. In the case of a processing where pressing and sintering are simultaneously carried out, a CIP mold body or a mold body subjected to preparatory sintering is machined, dimensional accuracy is improved, the mold body is set in a state where a plurality of pieces of portions are bonded together which is canned and subjected to HIP treatment. It is preferable to carry out the regular sintering and HIP treatment, for example, under an Ar atmosphere, with conditions of 1000–2000 kgf/mm$^2$, 1100–1200° C., 0.5–2 hours and holding further the mold body for 1–3 hours at 1300–1350° C. Or, a method of coating a binder on a bonding face is also preferable. Incidentally, Co, Ni, Cr or the like is preferable as a binder.

When the pressing is carried out after the regular sintering, it is preferable to carry out the regular sintering by fabricating a cylindrical member, a core member and upper and lower lids with high accuracy by machining a graphite mold material, setting sleeve members by overlapping them, maintaining an atmosphere of a vacuum furnace to $10^{-3}$–$10^{-5}$ mmHg by introducing a very small amount of hydrogen gas, holding the material for 0.5–2 hours at 1000–1200° C. and further holding the material for 1–3 hours at 1200–1350° C. The two stage heating is a measure for uniformly carrying out shrinkage deformation in the sintering. The sintered body after regular sintering is provided with substantially 94–98% of the intrinsic specific weight and the HIP treatment is carried out by holding the mold body under an Ar atmosphere, with 1000–2000 kgf/mm$^2$, at 1200–1350° C. for 1–3 hours.

According to the above-described two methods, the press sintering is carried out and the HIP treatment is carried out finally to integrate the hollow members and the treatment provides a result preferable in promoting the density of the mold body and promoting adhesion performance at the bonded face. The sleeve of the integrated hollow member obtained by the press sintering, is preferably polished, ground further by machining as necessary, a shaft member of the roll is inserted and fitted into the cavity portion and these are fixed by a normal method of burn fit, cool fit(shrinkage fit) or the like. Further, as the shaft member, a member fabricated by a normal process in which, for-example, chromium'steel, chromium molybdenum steel, high speed steel or the like is tempered, is used and a member having a diameter equivalent to the diameter of the cavity portion of the sleeve and having the length of about 1000–5000 mm, is used. Incidentally, as one example, physical properties of a part fabricated according to the above-described method by using a mixture of WC—15% Co are as follows. Hardness (HRA) is 86.0, the density is 13.8 g/cm$^3$ and transverse rupture strength is 210–250 kgf/mm$^2$. A composite sleeve roll obtained in this way is a large-sized long roll having a thick wall portion substantially at the central portion in the longitudinal direction of the shaft member and is used in forming or cold-rolling sheet member in the field of steel and nonferrous metal.

Further, an explanation will be given of cold rolling of a stainless steel strip requiring high brightness as an embodiment utilizing other roll of the present invention.

Firstly, the inventors have found that the surface brightness of a stainless steel product is controlled by the surface roughness of a steel strip after cold rolling, with regard to the surface roughness of the steel strip after cold rolling, a portion of the surface roughness of a steel strip before cold rolling (steel strip which has been annealed and pickled after hot rolling), remains after cold rolling and to provide a steel strip excellent in the surface brightness, recess portions on the surface of the steel strip present in starting the cold rolling are to be reduced during the rolling operation.

However, it is difficult to sufficiently bring protrusions on the surface of the roll into contact with the surface of the steel strip during cold rolling sufficiently to reduce the recess portions on the surface of the steel strip before cold rolling since in the case of a tandem cold mill using work rolls having large diameters, in comparison with a conventional small diameter roll mill, it is difficult to bring protrusions on the surface of the roll into contact with the surface of the steel strip sufficiently since a large amount of rolling oil is interposed between the roll and the steel strip. In order to deal with the situation, the inventors have discovered that it is effective to satisfy the following conditions (a) and (b).

(a) to make rolling oil difficult to be drawn between roll and steel strip such that it is drawn as less as possible.

(b) to cause sufficient pressure between roll and steel strip.

First, it is found in respect of (a) that the cause for drawing the rolling oil between the roll and the steel strip is derived from hydrodynamic force exerting on the rolling oil, the force is significantly influenced by a bite angle and the larger the angle the more difficult is the rolling oil to be drawn.

Hence, the inventors have paid attention to Young's modulus of the roll and reached a conclusion that the larger the Young's modulus of the roll, the more reduced is the flattening of the roll and as a result, the larger the bite angle can be made and the more difficult the rolling oil is drawn.

Figure 3:
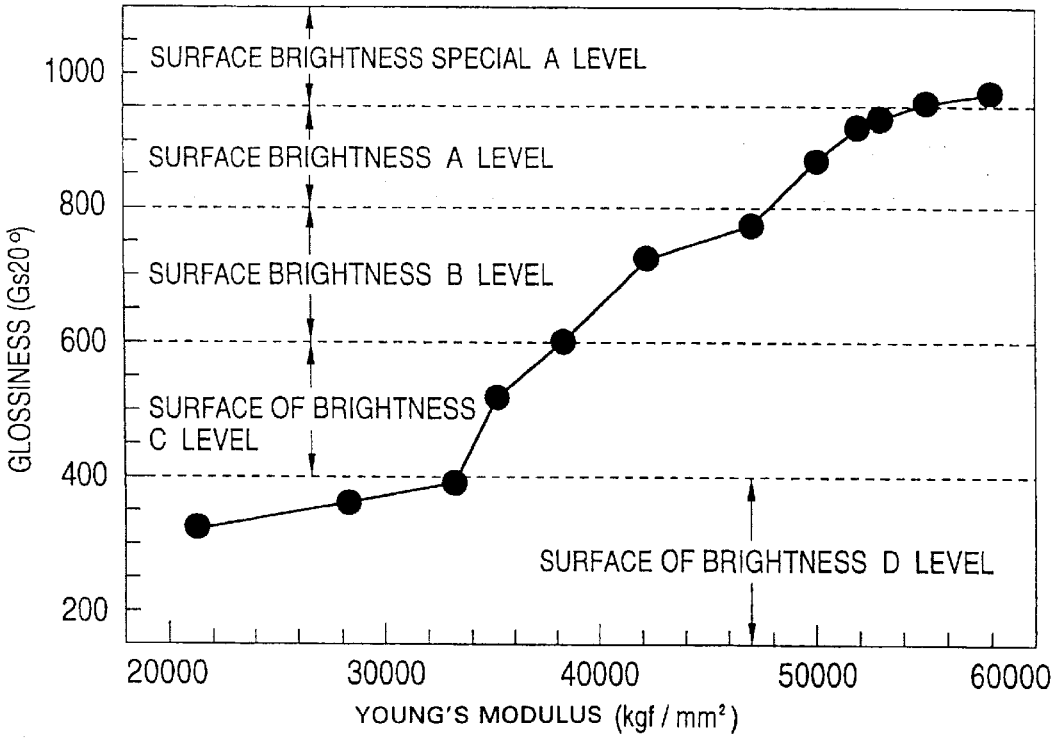
FIG. 3 is a graph showing, a relationship between Young's modulus of a sleeve member and surface brightness of a cold-rolled steel strip.

Hence, a mention will be given of a relationship between Young's modulus of the roll and the brightness of the surface of the steel strip after rolling. The inventors have measured the surface brightness of a cold-rolled stainless steel strip rolled by various rolls having different Young's modulus in accordance with JIS Z8741 "Brightness Measuring Method" (Gs20°). The result is evaluated in an order of excellence at five steps where glossiness of 950 or more is designated by special A, 800–950 is designated by A, 600–800 is designated by B, 400–600 is designated by C and 400 or less is designated by D. According to an experiment by the inventors, as shown by FIG. 3, it is found that while the brightness is promoted little by little when Young's modulus is increased from a value 21000 kgf/mm$^2$ of steel, when Young's modulus is equal to or larger than 35000 kgf/mm$^2$, the higher the value the more excellent is the brightness and when it is 50000 kgf/mm$^2$ or more, further excellent brightness is resulted which is preferable. Incidentally, generally speaking, when Young's modulus is high, a kind of brittleness is frequently resulted and it is not preferable in view of strength of the roll to use a material having excessively high Young's modulus as a material for roll. For example, although WC series hard alloys is pointed out as a material having high Young's modulus, it is preferable to set Young's modulus to 56000 kgf/mm$^2$ or lower by making Co content (equivalent bond amount) 12% or higher.

Further, it has been confirmed that when Young's modulus is increased, in addition to the above-described effect, an effect of causing sufficient pressure specified in the above-described (b) is achieved as a result of increasing pressure between the roll and the steel strip since a contact length between the roll and the steel strip is'shortened.

Now, when WC series hard alloys having high Young's modulus is used for a large diameter work roll as in a tandem cold mill as a material for promoting the brightness; a roll integral with WC series hard alloys may be used, however, there poses a problem where the cost is extremely increased. In order to resolve the problem, it is extremely effective to adopt a composite roll where WC series hard alloys constitutes a material for an outer layer and a core portion is constituted by a material of steel base. However, when such a composite roll is used, it is conceivable that the flattening deformation of the roll during the rolling operation may be different from that in the case of the roll integrated with WC series hard alloys. The brightness of the surface of the steel strip after rolling significantly relates to the flattened roll radius and the wall thickness of the roll barrel outer layer needs to be an optimum value such that the flattening deformation of the composite roll is not significantly different from that of the roll integrated with WC series hard alloys. When the wall thickness of the roll barrel outer layer is excessively increased, although the roll flattering can be made not different from that in the roll integrated with WC series hard alloys, yet the cost is increased and accordingly it is extremely important to set the wall thickness for making the function and the cost compatible with each other.

Figure 4:
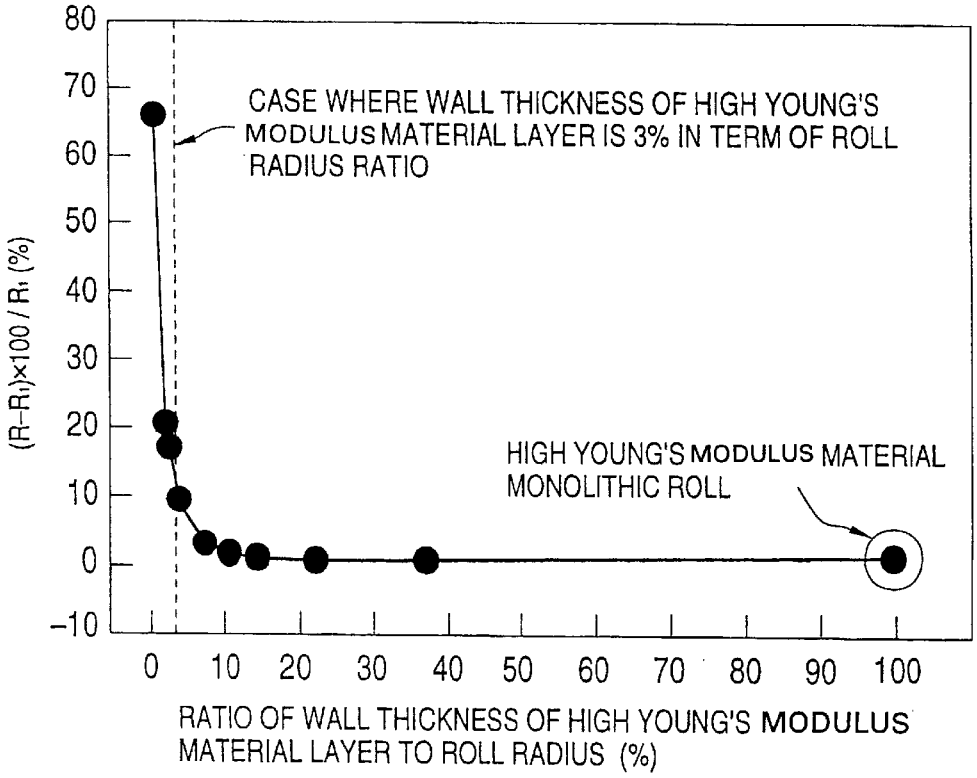
FIG. 4 is a graph showing a relationship between a ratio of a sleeve member having high Young's modulus in respect of a radius of a roll and the radius of the roll.
Figure 5:
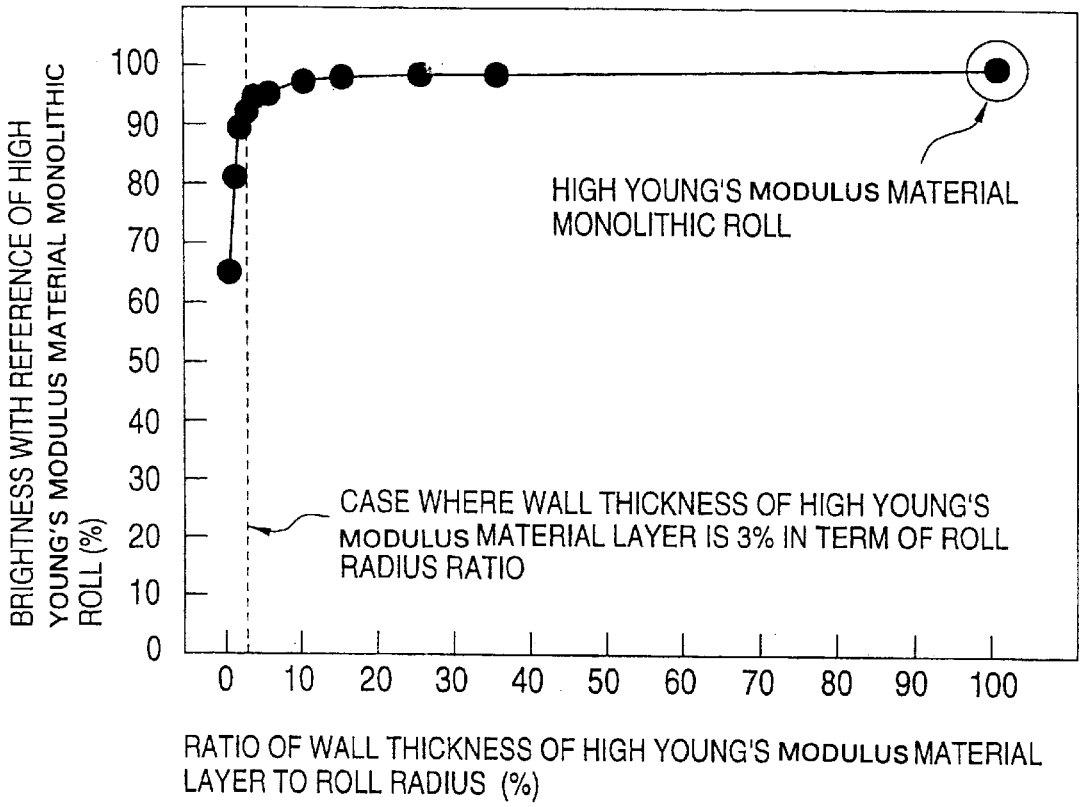
FIG. 5 is a graph showing a relationship between the ratio of the sleeve member having high Young's modulus in respect of the radius of the roll and surface brightness of a cold-rolled steel strip.

The inventors have intensively studied in respect of the wall thickness of the outer layer of the composite roll using WC series hard alloys at the outer layer in view of the above-described points, through FEM analysis and rolling experiments. According to FIG. 4, when the flattened roll radius of the roll comprised of monolithic body of WC series hard alloys having high Young's modulus (Young's modulus; 51000 kgf/mm$^2$) is designated by notation $R_1$, a difference between a flattened roll radius R of a composite roll where the wall thickness of an outer layer is variously changed and $R_1$ is represented by $(R-R_1)\times 100/R_1$ and a relationship between the ratio and a ratio of the wall thickness of the outer layer to the radius is shown. Further, FIG. 5 shows a relationship between the surface brightness of a cold-rolled steel strip and the ratio of the wall thickness of the outer layer to the radius, similarly represented. As shown by FIG. 4 and FIG. 5, it has been found that while in the case of a roll integral with steel (Young's modulus; 21000 kgf/mm$^2$) a difference of the flattened roll radius from that of the roll comprised of monolithic body of WC series hard alloys is about 70%, in respect of the flattened roll radius of the composite roll, when the wall thickness of the outer layer is about 3% of roll radius, a difference of the flattened roll radius from that of the roll integral with WC series hard alloys is within 10% and a sufficient effect can be achieved in respect of the brightness. Further, it has been also found that when the wall thickness of the WC outer layer is set to 10% or more of the roll radius, a difference of the flattened roll radius from that in the case of the roll integral with WC series hard alloys can be made 2% or less and higher effect can be achieved in respect of the brightness. Accordingly, the wall thickness of the WC outer layer is preferably 3% or more of the roll radius, more preferably, 10% or more of the roll radius.

Further, as a result of studying the relationship between the roll radius and the outer layer wall thickness by the inventors, it has been found that even when Young's modulus of the outer layer is changed, this relation remains substantially the same.

Figure 6:
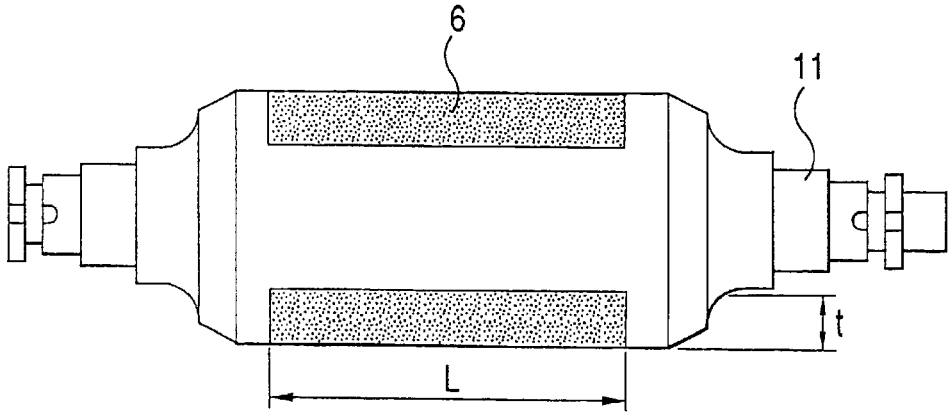
FIG. 6 is a view for explaining dimensions L and t of a fit roll of the present invention.

Next, the inventors have studied in respect of a ratio L/D of a barrel length L to a diameter D of a fit roll. As a result, it has been found that as shown by Table 1, when the ratio is excessively large, a danger of breaking the roll by bending the roll during the rolling operation is enhanced and therefore, the ratio needs to be a constant value or lower. According to the study of the inventors, the ratio is preferably 10 or less, more preferably 7 or less. Meanwhile, in rolling a steel strip by using the roll, L/D needs to be 2 or more in view of shape control capacity. Accordingly, a range of L/D is preferably 2 through 10, more preferably 2. through 7. Further, the barrel length L in the present invention is indicated by a length of a WC alloy sleeve shown by FIG. 6.

Figure 7:
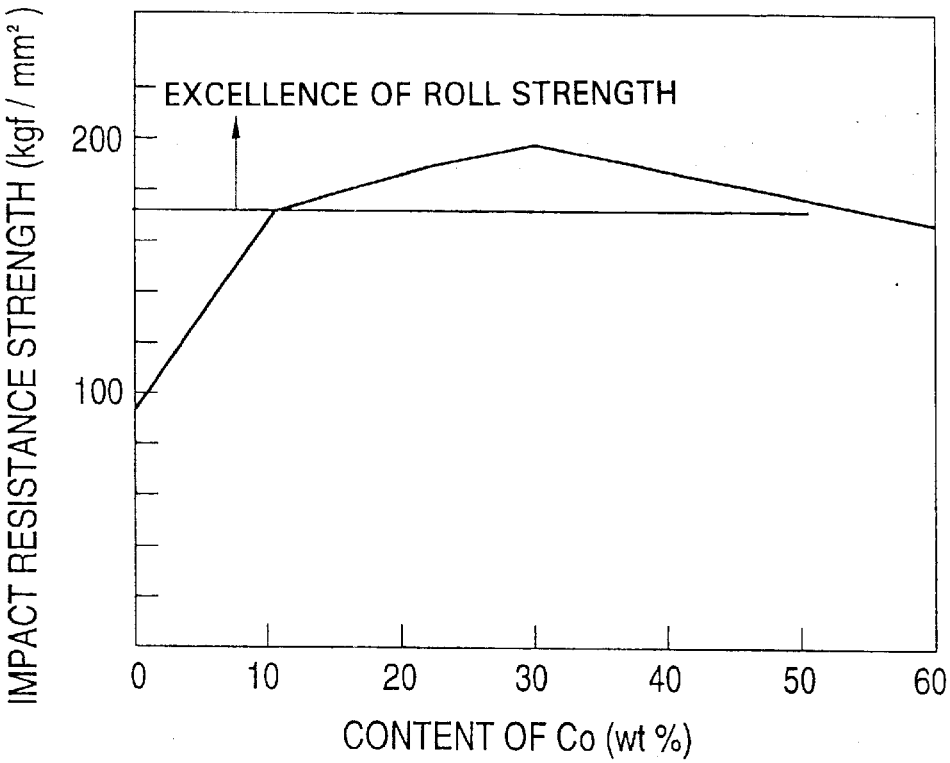
FIG. 7 is a graph showing a relationship between a Co content in a WC—Co series hard alloys and impact resistance strength.
Figure 8:
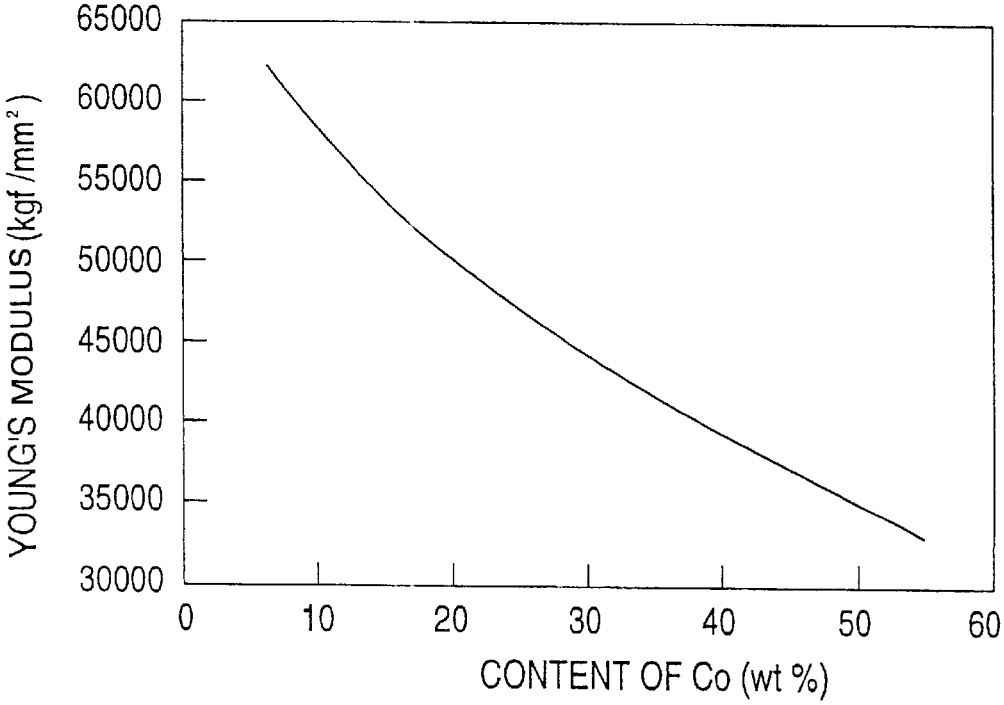
FIG. 8 is a graph showing a relationship between the Co content in the WC—Co series hard alloys and Young's modulus.

Further, generally speaking, a material having extremely high Young's modulus is frequently a brittle material and it is not preferable in view of strength, particularly strength against impact to use a material having an excessively high Young's modulus as a material for roll. For example, it is known that in the case of WC series hard alloys as a material having high Young's modulus, WC—Co series hard alloys with Co as a binder metal is provided with high Young's modulus, excellent in transverse rupture strength and excellent also in impact resistance strength. The inventors have intensively studied on Co content in WC—Co series hard alloys mentioned above. As a result, it has been found that by making Co content 12 weight % (hereinafter, abbreviated as %) or more as shown by FIG. 7, durability against impact caused by strip pincher or the like during the rolling operation is promoted. Further, it has also been found that although the higher the Co content the higher the impact resistance strength, when it is excessively high, as shown by FIG. 8, Young's modulus is decreased to 35000 kgf/mm$^2$ or less, the brightness is deteriorated and therefore, the Co content is preferably set in a range of 12 through 50%.

Figure 9:
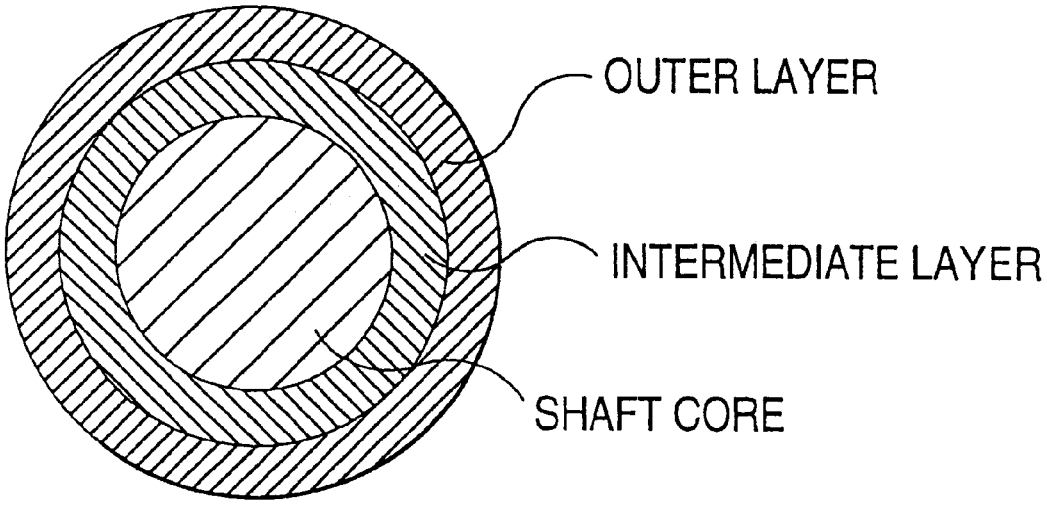
FIG. 9 is a schematic view of a section of a barrel portion of a composite roll in the present invention.
Figure 10:
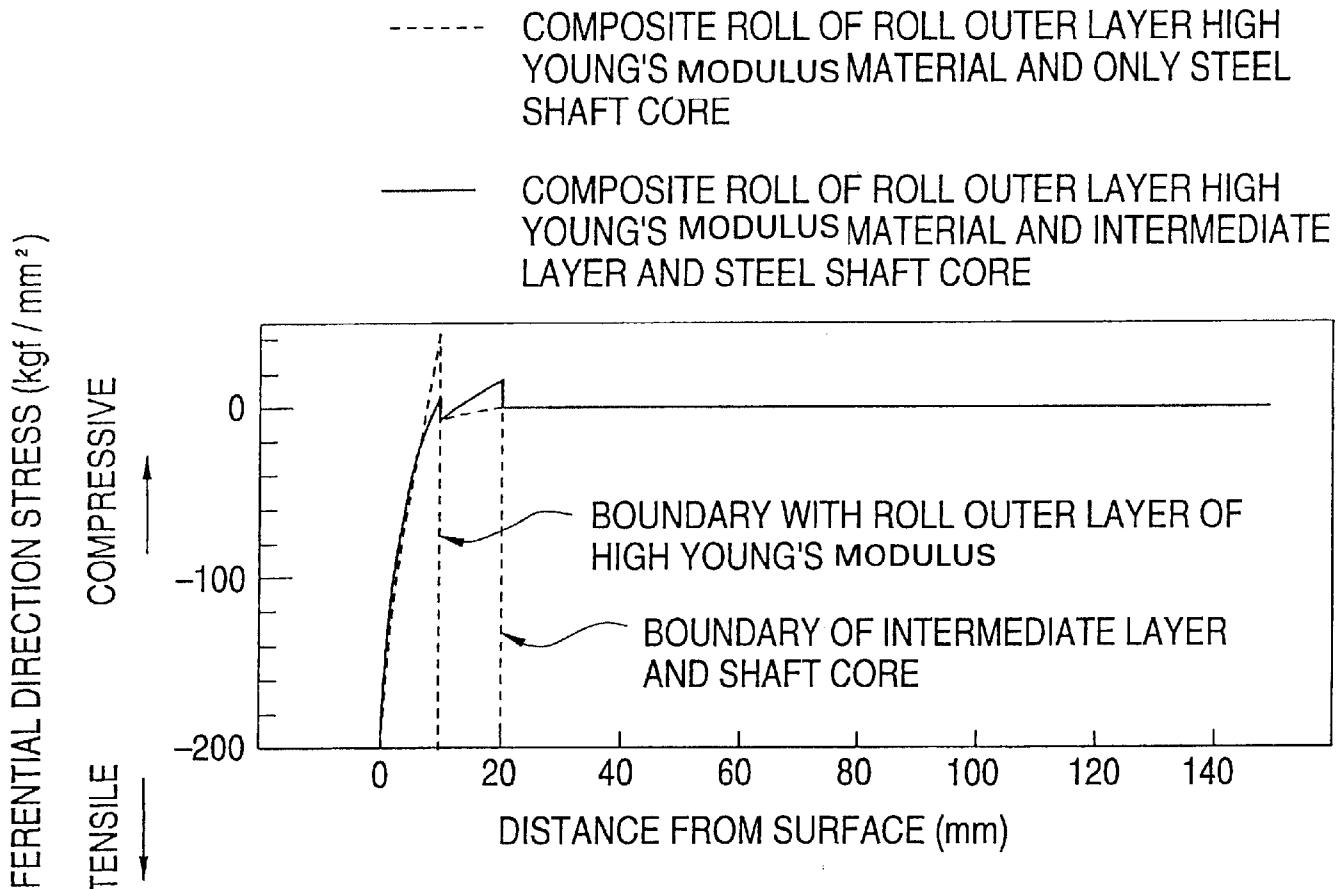
FIG. 10 is a diagram showing circumferential direction stress distribution at layer boundaries of the composite roll in the present invention.

Meanwhile, when the roll is made composite in this way, a tensile stress is caused on a peripheral face on the inner diameter side under the outer layer of roll during the rolling operation due to discontinuity of Young's modulus at a boundary between the roll outer layer having high Young's modulus material and the shaft core made of steel and when the stress is increased to exceed a limit, it amounts to breakage of roll. Hence, the inventors have found that the stress can be alleviated by providing an intermediate layer made of a material having Young's modulus smaller than that of the outer layer and larger than that of the shaft core between the roll outer layer and the roll shaft core to alleviate the stress as shown by FIG. 9. FIG. 10 shows a radius direction distribution of the stress. As shown by FIG. 10, in the case of a composite roll comprising two layers of an outer layer having high Young's modulus and a shaft core of steel that is the Conventional Example, large tensile stress is caused at an inner portion of the outer layer at a vicinity of a boundary between the outer layer and the shaft core which is liable to cause breakage of roll. By contrast, by providing an intermediate layer according to the present invention, both of a tensile stress at a vicinity of a boundary between an outer layer and an intermediate layer and a tensile stress at a vicinity of a boundary between the intermediate layer and a shaft core are reduced more than that in the conventional case and the roll can be used stably without breakage.

The inventors have studied further on a method of alleviating the tensile stress. Further, they have grasped that the tensile stress can further be alleviated by decreasing a difference between Young's moduli since the tensile stress is caused by the difference between Young's modulus of the roll outer layer and the intermediate layer. However, when Young's modulus of the intermediate layer is made near to Young's modulus of the roll outer layer, the difference between Young's moduli of the intermediate layer and the roll shaft core is increased and large tensile stress is exerted on the inner face of the intermediate layer. Hence, as a result of further study, the inventors have found that it is extremely effective to provide a plurality of layers of two layers or more for the intermediate layers in order to resolve such a phenomenon.

Further, the inventors have found that when, for example, WC series hard alloys is used as a material having high Young's modulus, the structure is extremely uniform and in respect of the surface roughness of roll which is set to low at an initial stage of rolling, the roughness is not increased as in steel base roll even when an amount of rolling is increased and wear is enlarged. In this case, WC series hard alloys is constituted by adding a single or a plurality of kinds of an Ni base alloy, a Co base alloy, Ti, Cr and the like to WC (tungsten carbide) which is the major component. Further, by reducing an equivalent bond amount of Ni, Co, Ti, Cr or the like which is a binder metal, Young's modulus gradually increases and tensile stress operated among layers is alleviated.

Accordingly, when WC series hard alloys is used at the uppermost layer and the intermediate layer, it is preferable that in respect of the composition of hard alloys, the more relatively outer side the layer is, the more the equivalent bond amount of the binder metal is decreased.

EXAMPLES (Embodiment 1)

Powder produced by mixing WC having a particle diameter of 3 through 5 $\mu$m with powder mixed with Co having a diameter of about 1 through 2 $\mu$m (Co: 15 wt %) for 2 days with balls made of WC as mixing media, is packed into a gap constituted by an outer cylinder and an inner cylinder of a double cylinder mold made of rubber where a core rod in a pipe-like shape having a diameter of about 180 mm and a length of 1000 mm is inserted into a central axis portion of double cylinders having an inner diameter of the outer cylinder of about 400 mm and a depth thereof of 850 mm and an inner diameter of the inner cylinder of about 180 mm. A method of repeatedly carrying out steps of placing the rubber mold on a hammer type packing machine, packing the powder by equal amounts and thereafter pressing the powder, is adopted in the packing operation.

Next, the core rod is drawn and a mold body where the central axis portion is penetrated by a cavity is formed. In a similar manner, 2 pieces of the mold bodies are fabricated. The mold bodies are subjected to CIP treatment by holding them for 10 minutes at 2850 kgf/cm$^2$. The mold body provided by the CIP treatment is a hollow member having an outer diameter of 330 mm, an inner diameter of 160 mm and a length of 730 mm, the surface, an inner face and a bond face thereof are further smoothed by machining to thereby finish to predetermined dimensions, two pieces of the hollow members are mounted to a core member made of graphite, a very small amount of hydrogen is introduced into a vacuum furnace and the member is subjected to primary sintering for 2 hours at 1120° C. under $10^{-3}$–$10^{-5}$ mmHg. The primary sintered body is mounted further to a core member made of graphite and is subjected to secondary sintering for 2 hours at 1250° C. The sintered body is subjected to HIP treatment for 2 hours with 1000 kgf/cm$^2$ at 1330° C. under an Ar atmosphere. The transverse rupture strength at the bond portion of the mold body which is a sleeve subjected to HIP treatment is 180–220 kgf/mm$^2$. Further, the hardness is 86–88 HRA.

Next, 5% chromium steel is tempered, a shaft member portion having a diameter of about 140 mm and a length of about 3500 mm is inserted into the sleeve having an outer diameter of 280 mm, an inner diameter of 140 mm and a length of 1230 mm and a roll is constituted by machining. When a steel strip is rolled by using the roll, excellent thin sheet is obtained with no breakage of roll.

(Embodiment 2)

A steel strip of SUS 430 is used as a ferritic stainless steel strip, a hot-rolled strip is annealed and pickled, thereafter, work roll in each of which a WC series hard alloys sleeve and high alloy steel are fitted together are used as Invention Example 2 at a fifth stand of a 5 stand tandem cold mill and cold rolling is carried out from a thickness of mother material of 4.0 mm to a finish thickness of, 1.0 mm. Thereafter, the steel strip is subjected to finish annealing and picking and temper-rolled by an elongation ratio of 1.0%. With regard to the specification of the WC series hard alloys sleeve roll, as shown by Table 2, the outer diameter of the sleeve is 285 mm, the material of the outer layer is WC series hard alloys including 17% of Co and with Young's modulus of about 52000 kgf/mm$^2$and the wall thickness of the sleeve is 5 mm (3.5% of roll radius).

Further, as a Comparative Example, work rolls integral with WC series hard alloys including 17% of Co and having the roll diameter of 285 mm is used at the fifth stand and cold rolling is carried out. Thereafter, the steel strip is subjected to finish annealing and pickling and temper-rolled by an elongation rate of 1.0% (Comparative Example 2a).

Further, as other Comparative Example, WC composite work rolls having the roll diameter of 285 mm where WC series hard alloys including 17% of Co is built by a wall thickness of 2 mm by spraying it to a core member of high alloy steel, is used at the fifth stand and cold rolling is carried out. Thereafter, the steel strip is subjected to finish annealing and pickling and temper-rolled by an elongation rate of 1.0% (Comparative Example 2b).

Further, as Conventional Example 2, cold rolling is similarly carried out in respect of a case where work rolls using normal 5% Cr forged steel are used at all the stands of the 5 stand tandem cold mill. Thereafter, the steel strip is subjected to finish annealing and pickling and temper-rolled in an elongation rate of 1.0%.

The surface brightness is measured in accordance with JIS Z8741 "Glossiness Measuring Method" (Gs 20°) with regard to the respective cold-rolled stainless steel strips obtained by the above-described methods. The result is evaluated by 5 stages in an order of excellence in which the Glossiness of 950 or more is designated by special A, 800–950 is designated by A, 600–800 is designated by Br 400–600 is designated by C and 400 or less is designated by D. The result is shown by Table 3. According to Table 3, the cold-rolled stainless steel strip that is rolled by using the sleeve fit roll according to the present invention is equivalent to the steel strip produced by using the roll integral with WC series hard alloys of Comparative Example 2a and is provided with brightness significantly superior to those of the steel strips produced in Comparative Example 2b and Conventional Example.

(Embodiment 3)

A steel strip of SUS 304 is used as an austenitic stainless steel strip, a hot-rolled steel strip is annealed and pickled, thereafter, work rolls in each of which a WC alloy sleeve and hot die steel are fitted together are used as Invention Example 3 at all the stands of a 5 stand tandem cold mill and cold rolling is carried out from a thickness of mother material of 3.0 mm to finish a thickness of 0.98 mm. Thereafter, the steel strip is subjected to finish annealing and pickling, temper-rolled in an elongation ratio of 1.0% and subjected to 1 pass of buffing of #400.

The specification of the WC alloy sleeve according to the Invention Example is shown by Table 4. As indicated in an upper column of the table, the sleeve is made of WC series hard alloys including 20% of Co and having Young's modulus of about 50000 kgf/mm and the wall thickness of the sleeve is about 10% of roll radius.

Further, as Comparative Example 3, work rolls in each of which a core member of hot die steel is fitted to a WC series hard alloys sleeve are used at the fifth stand and cold rolling is carried out. Thereafter, the steel strip is subjected to finish annealing and pickling, temper-rolled by an elongation ratio of 1.0,% and is subjected to 1 pass of buffing of #400 (Comparative Example 3).

The specification of the sleeve in the Comparative Example is shown at a lower column of Table 4. The sleeve is made of WC series hard alloys including 17% of Co, 28% of Ni and 7% of Cr and having Young's modulus of 33000 kgf/mm$^2$ and the wall-thickness is about 10% in the ratio of roll radius.

Further, as Conventional Example 3, normal 5% Cr forged steel is used at all the stands of a 5 stand tandem cold mill and Young's modulus is about 21000 kgf/mm$^2$. Cold rolling is similarly carried out in respect of a case where the work rolls are used. Thereafter, the steel strip is subjected to finish annealing and pickling, temper-rolled by an elongation ratio of 1.0% and is subjected to 1 pass of buffing of #400.

With regard to the respective cold-rolled stainless steel strips obtained by the above-described methods, the surface brightness is measured and evaluated similar to Example 2. The result is shown summerizingly in Table 5. According to Table 5, the cold-rolled stainless steel strip rolled by using the sleeve fit roll according to the present invention is provided with brightness extremely superior to those of the steel strips produced in Comparative Example 2 and Conventional Example.

(Embodiment 4)

A SUS 304 steel strip is used as an austenite series stainless steel strip, a hot-rolled steel strip is annealed and picked, thereafter, as Invention Example 4, work rolls constituted by rolls in each of which a WC series hard alloys sleeve and a core member of 5% Cr forged steel are fitted together, are used at a third stand of a 5 stand tandem cold mill and cold rolling is carried out from a thickness of mother sheet of 3.0 mm to a finish thickness of 0.98. mm. In this case, reduction ratio of respective stands are adjusted in respect of 2 levels of 20% and 30% in the reduction ratio of the third stand. Thereafter, the steel strip is subjected to finish annealing and pickling, temper-rolled by an elongation ratio of 1.0% and subjected to 1 pass of buffing of #400. As shown by Table 6 and Table 7, according to the sleeve of the Invention Example, a material of a sleeve outer layer is WC series hard alloys including 20% of Co and having Young's modulus of about 50000 kgf/mm$^2$ and a wall thickness of the sleeve is about 10% of the roll radius. Under the condition, the size of the roll is changed by 2 levels of a case where the sleeve diameter is 231 mm, the roll barrel length L is 1500 mm and a ratio L/D in respect to the roll diameter D is 6.5 (Invention Example 4a) and a case where the sleeve diameter is 155 mm, the roll barrel length L is 1500 mm and the ratio L/D in respect to the roll diameter D is 9.7 (Invention Example 4b).

Further, as Comparative Example 4, work rolls in each of which a sleeve in which the material of an outer layer is WC series hard alloys of WC—20% Co as shown by Table 6, the wall thickness is 7 mm (radius ratio; 10%), the sleeve diameter is 135 mm and the roll barrel is 1500 mm (L/D= 11.1) and a core member of 5% Cr forged steel are fitted together, are used at the third stand and cold rolling is carried out. Thereafter, the steel strip is subjected to finish annealing and pickling, temper-rolled by an elongation ratio of 1.0% and is subjected to 1 pass of buffing of #400.

Further, as a Conventional Example, cold rolling is also carried out similarly in a case where work rolls using normal 5% Cr forged steel and having Young's modulus of about 21000 kgf/mm$^2$ are used for all the stands of the 5 stand tandem cold mill. Thereafter, the steel strip is subjected to finish annealing and pickling, temper-rolled by an elongation ratio of 1.0% and is subjected to 1 pass of buffing of #400.

With regard to the respective cold-rolled stainless steel strips provided as described above, the surface brightness is measured and evaluated similar to Embodiment 2 and breakage of roll during the rolling operation is also investigated. The result is shown by Table 7. According to Table 7, a result significantly superior to the steel strip produced in the Conventional Example is provided in each of the cold-rolled stainless steel strips produced by the rolling rolls according to the present invention. Particularly, no breakage of roll is caused in the Invention Example 4a where L/D=7 or less even with the reduction ratio of 30% or more.

(Embodiment 5)

A SUS 304 steel strip is used as an austenitic stainless steel strip, a hot-rolled steel strip is annealed and pickled and thereafter, work rolls in each of which a WC series hard alloys sleeve and hot die steel are fitted together are used as Invention Example at a fifth stand of a 5 stand tandem cold mill and cold rolling is carried out from a thickness of mother sheet of 3.0 mm to a finish thickness of 0.98 mm. In this case, the reduction rate of the fifth stand is set to 20%. Thereafter, the steel strip is subjected to finish annealing and pickling, temper-rolled in an elongation ratio of 1.0% and is subjected to 1 pass of buffing of #400. In this case, in respect of the WC series hard alloys sleeve, the wall thickness is set to about 3% in the ratio to the roll radius and the content of Co is varied from 6% to 55%.

Further, as a Conventional Example, cold rolling is carried out similarly in a case where work rolls using normal 5% Cr forged steel and Young's modulus of about 21000 kgf/mm$^2$ are used at all the stands of the 5 stand tandem cold mill. Thereafter, the steel strip is subjected to finish annealing and pickling, temper-rolled in an elongation ratio of 1.0% and is subjected to 1 pass of buffing of #400.

In the above-described cold rolling, as an investigation on the strength against impact, an investigation is carried out on presence or absence of roll breakage caused by strip thickness variation in the case of strip pincher or passing of a weld point at the fifth stand. Further, with regard to the respective cold-rolled stainless steel strips obtained, the surface brightness is measured and evaluated similar to Embodiment 2. According to a result shown by Table 8, excellent brightness significantly superior to those of the steel strips produced by the Comparative Example and the Conventional Example is achieved by the cold-rolled stainless steel strip rolled by fit rolls according to the present invention having the wall thickness of 3% or more of roll radius, Co content of 12 through 50% and Young's modulus of 35000 kgf/mm$^2$ or more and further, the stress against impact is high and no breakage is caused.

(Embodiment 6)

A SUS 430 steel strip is used as a ferrite group stainless steel strip, a hot-rolled steel strip is annealed and pickled, thereafter, as an Invention Example, composite work rolls each comprising 3 layers in which a shaft core is made of 5% Cr forged steel, an outermost layer is made of WC series hard alloys of Co 17% having Young's modulus of 52000 kgf/mm$^2$, an intermediate layer is made of WC series hard alloys of Co 40% having Young's modulus of about 39000 kgf/mm$^2$, the diameter is 285 mm, a wall thickness of the outermost layer is 5 mm (3.5% of roll radius) and a wall thickness of the intermediate layer is 4 mm, are used at a fifth stand (roll diameter ø; 285 mm) of a 5 stand tandem cold mill and cold rolling is carried out from a thickness of the hot-rolled steel strip of 4.0 mm. In this case, the reduction ratio at the fifth stand is set to 3 levels of 20%, 30% and 40%. Thereafter, the steel strip is subjected to finish annealing and pickling and is temper-rolled in an elongation ratio of 1.0%. (Invention Example 6a)

Further, as other Invention Example, composite work rolls each comprising 4. layers in which a shaft core is made of 5% Cr forged steel, an outermost layer is made of WC series hard alloys of Co 17% having Young's modulus of 52000 kgf/mm$^2$, an intermediate layer (intermediate layer 1) on the outer side is made of WC series hard alloys of Co 30% having Young modulus of about 44000 kgf/mm$^2$, an intermediate layer (intermediate layer 2) on the inner side is made of WC series hard alloys of Co 50% having Young's modulus of 35000 kgf/mm$^2$, the diameter is 285 mm, a wall thickness of the outermost layer is 5 mm, a wall thickness of the intermediate layer 1 is 4 mm and a wall thickness of the intermediate layer 2 is 3 mm, are used at the fifth stand and cold rolling is carried out. Thereafter, the steel strip is subjected to finish annealing and pickling and is temper-rolled in an elongation ratio of 1.0%. (Invention Example 6b)

Meanwhile, as a Comparative Example, integral work rolls each comprising WC series hard alloys including 17% of Co and having the roll diameter of 285 mm are used at the fifth stand and cold rolling is carried out. Thereafter, the steel strip is subjected to finish annealing and picking and is temper-rolled in an elongation ratio of 1.0% (Comparative Example 6a).

Further, integral work rolls each comprising WC series hard alloys including 17%) of Co, 28% of Ni and 7% of Cr having Young's modulus of, 33000 kgf mm are used at the fifth stand and cold rolling is carried out. Thereafter, the steel strip is subjected to finish annealing and pickling and is temper-rolled in an elongation ratio of 1.0%. (Comparative Example 6b).

Further, composite work rolls each comprising 2 layers in which a shaft core is made of 5% Cr forged steel, an outermost layer is made of WC series hard alloys of Co 17% having Young's modulus of about 52000 kgf/mm$^2$, the diameter is 285 mm and the wall thickness of the outer layer is 5 mm, are used at the fifth stand and cold rolling is carried out. Thereafter, the steel strip is subjected to finish annealing and pickling and is temper-rolled in an elongation ratio of 1.0% (Comparative Example 6c).

Further, as a Conventional Example, cold rolling is carried out similarly in a case where work rolls using normal 5% Cr forget steel are used at all the stands of the 5 stand tandem cold mill. The specifications of the fifth stand rolls in the respective examples mentioned above are shown by Table 9.

The surface brightness of the cold-rolled stainless steel strips are measured by JIS Z8741 "Glossiness Measuring Method" (Gs 20°) and evaluated by 5 stages in an order of excellence in which the Glossiness of 950 or more is designated by special A, 800–950 is designated by A, 600–800 is designated by B, 400–600 is designated by C and 400 or less is designated by D. According to a result shown by Table. 10, the cold-rolled steel strips produced by using the rolling rolls of the present invention, are equivalent to the steel strip produced by using the roll integral with WC series hard alloys of Comparative Example 6a and is provided with the brightness which is significantly superior to those of the steel strips produced by Comparative Examples 6b, 6c and Conventional Example.

Further, also in respect of the strength of roll, no breakage of roll is caused and excellent result is obtained even with a reduction ratio higher than those in the cases of Comparative Example 3 and Comparative Example 4.

By contrast, according to the Conventional Example, heat streak (seizure defect) is caused on the surface of the rolled material and on the surface of the roll at a reduction ratio of 30% or more and the surface brightness is failed.

(Embodiment 7)

Annealing for hot-rolled sheet is carried out in respect of a hot-rolled- steel strip for grain-oriented silicon steel including C: 0.045% Si: 3.35%, Mn: 0.065%, Se: 0.017% and Sb: 0.027% having a thickness of 2.5 mm at 1000° C. for 30 seconds, the annealed steel strip is subjected to cold rolling to a thickness of 0.64 mm. after pickling and successively subjected to an intermediate annealing at 980° C. for 90 seconds by which 4 kinds of samples A, B, C and D are prepared. Thereafter, surfaces of the samples A and C are ground in parallel with the rolling direction by using a grinding belt having a grain sized of #100. The samples B and D stay as annealed by the intermediate annealing.

The samples are finished to a final strip thickness of 0.23 mm by a 3 stand tandem mill provided with rolling rolls having the roll diameter of 350 mm and the roll surface roughness of 0.1 $\mu$m Ra by using a rolling oil having the viscosity of 8 cst/50° C. and the concentration of 3% at a final stand rolling speed of 1000 mpm. The reduction ratio at the final stand is set to 20%.

In respect of coils A and B, as one Invention Example, WC composite rolls shown by Table 11 are used and in respect of coils C and D, as a Comparative Example, conventional high alloy steel rolls are used. A result of measuring the average surface roughness (Ra) of a strip subjected to the final stand rolling speed of 1000 mpm is shown by Table 12 in respect to samples as rolled. As is apparent from Table 12, the samples A and B obtained by using the rolls of the Invention Example are provided with surface conditions superior to those of the samples-C and D which are Conventional Examples. Although according to the sample B, grinding by the grinding belt has not been carried out after the intermediate annealing, the surface roughness of the steel strip as rolled is a little smaller and more excellent than that in the case where the steel, strip is rolled by high alloy steel rolls and ground.

Further, a result of investigating a trimming amount at both end edge portions of sheet width necessary for producing a material requiring a deviation of 5 $\mu$m in respect of the product sheet thickness with regard to the samples as rolled is shown by Table 12. As shown by Table 12, it is known that compared with the samples C and D which are Comparative Examples, according to the samples A and B which have been rolled by using the rolls of the present invention, the edge drop is small, the trimming amount is reduced and the yield is promoted.

Further, Table 12 shows an average value of a result of measuring a texture of a surface layer in respect of the sample A produced by the rolls of the present invention and the sample C produced by the high alloy steel rolls of the Conventional Example which are subjected to decarburization annealing after cold rolling. As shown by Table 12, it is found that (110) intensity of the texture of the sample A produced by the rolling rolls of the present invention is larger than that of the sample C in the Conventional Example. This is ascribed to that in the rolling by using the WC rolls, Young's modulus of the WC roll is high and therefore, and an amount of oil introduced into the roll bite is decreased and the friction coefficient is increased to a degree twice as much as that in the case of the high alloy steel rolls and therefore, an amount of shear deformation is increased in the surface layer of the strip, Goss orientation crystal grains are formed there and the aggregation degree is promoted. Further, {110} <001> oriented crystal grains are grown by the finish annealing thereafter and as shown by Table 12, the magnetic properties are also promoted.

(Embodiment 8)

An electromagnetic steel strip (sheet thickness; 2.6 mm) is used, the steel strip is pickled, thereafter, composite rolls in each of which an outer periphery of the roll that is the present invention, is made of tungsten carbide series hard alloys including 20 weight % of nickel with the balance of tungsten carbide and is provided with a wall thickness of 20 mm (9.3–10.5% of roll radius) and cold die steel is used for a shaft core and the outer periphery and the shaft core are fitted together, are used as work rolls at all the stands (work roll diameter; 380–430 mm) of a 4 stand tandem cold mill and high speed rolling is carried out while supplying a rolling oil of a synthetic ester group emulsion at 60° C., with a concentration 2% and an average particle size of 3 $\mu$m by a circulating oil supply system to a finish thickness of 0.5 mm.

Further, as a Comparative Example, a hot-rolled steel strip (sheet thickness; 2.6 mm) of the same kind is used, the steel strip is pickled, thereafter, composite rolls in each of which an outer periphery thereof is made of tungsten carbide series hard alloys including 8 weight % of nickel with the balance of tungsten carbide and is provided with a wall thickness of 10 mm (4.6%–5.2% of roll radius), a shaft core thereof is made of cold die steel and the outer periphery and the shaft core are fitted together, are used as work rolls at all the stands of the tandem cold mill and the steel strip is rolled to a final thickness of 0.5 mm similar to the above-described.

Further, as a Conventional Example, a hot-rolled steel strip (sheet thickness; 2.6 mm) of the same kind is used, the steel strip is pickled, thereafter, work rolls made of conventional high alloy steel are used at all the stands of the tandem cold mill and the steel strip is rolled to a final thickness of 0.5 mm similar to the above described.

Breakage situation of roll is observed during the cold-rolling operation, after cold rolling, samples are sampled from steel strips, wear powder remaining on the surface of the steel strips is measured, further, the steel strips are rewound, the surface is observed and presence or absence of oil burn is investigated. Further, according to Table 13 in which nonuniformity such as oil burn, oil stain or the like on the surface of the steel strips is investigated after annealing the steel strips by a continuous annealing line having an alkaline electrolytic cleaning step, when cold rolling is carried out by using the work rolls of the Invention Example, an amount of wear powder remaining of the surface of the steel strip after rolling is significantly small, oil burn is not caused, and nonuniformity such as oil stain or the like is not caused on the surface of the steel strip after continuous annealing. Meanwhile, according to Comparative Example, although an amount of wear powder remaining on the surface of the steel strips after rolling is significantly small and oil-burn is not caused, a portion of the roll is broken, a defect is caused on the surface of the steel sheet, the breakage, is enlarged thereafter and rolling is stopped. According to Conventional Example, the amount of wear powder remaining on the surface of the steel strip after rolling is large, oil burn is caused at a final portion of the rolled steel strip and nonuniformity of oil stain is caused on the surface of the steel strip after continuous annealing.

TABLE 1

| L/D | 1.5 | 2.0 | 5.0 | 7.0 | 8.5 | 10.0 | 11.0 |
|---|---|---|---|---|---|---|---|
| Breakage of roll at reduction ratio 20% | ○ | ○ | ○ | ○ | ○ | ○ | × |
| Breakage of roll at reduction ratio 40% | ○ | ○ | ○ | ○ | × | × | × |
| Shape control capacity | × | Δ | ○ | ○ | ○ | ○ | — |

Reduce annealed of material of SUS 304 by 1 pass

Symbols in roll breakage

○ : Not broken

×: Broken

Symbols in shape control capacity

○ : Shape control capacity is excellent

Δ: Shape control is feasible

×: Shape control is not feasible

—: Rolling is not feasible

TABLE 2

| Spec. of #5 stand in invented example | | | | |
|---|---|---|---|---|
| Roll dia. | 285 mm | | | |
| Kind of roll | WC composite sleeve fitted with shaft core of high alloy steel | | | |
| Outer layer of composite sleeve | Material | Young's modules | Wall thickness | Wall thickness/roll radius |
| | WC-17%Co | 52000 kgf/mm$^2$ | 5 mm | 3.5% |
| Inner layer of composite sleeve | Material | Young's modules | Wall thickness | |
| | Mild steel | 21000 kgf/mm$^2$ | 10 mm | |

TABLE 3

| Rolled material: SUS 430 Mother plate thickness/finish thickness: 4.0 mm/1.0 mm 5 stand tandem cold mill | | | | | | |
|---|---|---|---|---|---|---|
| | Stand | Roll dia. (mm) | L/D | Roll material | Young' modulus (kgf/mm$^2$) | Determination of surface brightness of Product strip |
| Invented example 2 | 1–4 | 540 | 3.3 | 5% Cr forged steel | 21000 | A |
| | 5 | 285 | 5.0 | Described in Table 2 | 52000 | |
| Comparative Example 2a | 1–4 | 540 | 3.3 | 5% Cr forged steel | 21000 | A |
| | 5 | 285 | 5.0 | WC-17%Co monolithic roll | 52000 | |
| Comparative Example 2b | 1–4 | 540 | 3.3 | 5% Cr forged steel | 21000 | C |
| | 5 | 285 | 5.0 | Roll sprayed with WC-17%Co by 2 mm wall thickness | 52000 | |
| Conventional Example | 1–5 | 540 | 3.3 | 5% Cr forged steel | 21000 | D |

TABLE 4

| Roll spec. of Invented example and Comparative Example | | | | | | |
|---|---|---|---|---|---|---|
| Invented example 3 | Roll dia. | | 540 mm, 285 mm | | | |
| | Kind of roll | | WC composite sleeve fitted with shaft core of hot die steel | | | |
| | | | Material | Young' modulus | Wall thickness | Wall thickness/ roll radius |
| | Outer layer of composite sleeve | Ø540 mm Ø285 mm | WC-20%Co | 50000 kfg/mm$^2$ | 27 mm 14 mm | 10% |
| Comparative Example 3 | Roll dia. | | 540 mm, 285 mm | | | |
| | Kind of roll | | WC composite sleeve fitted with shaft core of hot die steel | | | |
| | | | Material | Young' modulus kgf/mm$^2$ | Wall thickness | Wall thickness/ roll radius |
| | Outer layer of composite sleeve | Ø540 mm Ø285 mm | WC-17%Co −28% Ni −7% Cr | 33000 kgf/mm$^2$ | 27 mm 14 mm | 10% |

TABLE 5

| Rolled material: SUS304 Mother plate thickness/finish thickness: 3.0 mm, 0.98 mm 5 stand tandem cold mill | | | | | | |
|---|---|---|---|---|---|---|
| | Stand | Roll dia. (mm) | L/D | Roll material | Young' modulus (kgf/mm$^2$) | Determination of surface brightness of product strip |
| Invented example 3 | 1–4 | 540 | 2.9 | Described in Table 4 | 50000 | Special A |
| | 5 | 285 | 4.5 | | | |
| Comparative Example 3 | 1–4 | 540 | 2.9 | Described in Table 4 | 33000 | C |
| | 5 | 285 | 4.5 | | | |
| Conventional Example | 1–4 | 540 | 2.9 | 5% Cr forged steel | 21000 | D |
| | 5 | 285 | 4.5 | | | |

TABLE 6

| Roll spec. of Invented example and Comparative Example | |
|---|---|
| Sleeve material | WC-20Co |
| Wall thickness of sleeve | Roll radius 10% |

TABLE 6-continued

| Roll spec. of Invented example and Comparative Example | | | |
|---|---|---|---|
| Roll barrel length | 1500 mm | Arbor material | 5% Cr forged steel |
| WC roll outer layer fitted with 5% Cr forged steel | | | |

TABLE 7

| Rolled material: SUS 304, (3.0/0.98 mm), 5 stand tandem cold mill | | | | | | |
|---|---|---|---|---|---|---|
| | | | 3 std. Breakage of roll at reduction ratio of 20% | | 3 std. Breakage of roll at reduction ratio of 30% | |
| | Roll dia. (mm) | L/D | Presence or absence of breakage | Determination of surface Brightness of product strip | Presence or absence of breakage | Brightness surface brightness of product strip |
| Invented Example 4a | 231 | 6.5 | None | B | None | A–B |
| Invented | 155 | 9.7 | None | B | Present. | — |

TABLE 7-continued

| | Rolled material: SUS 304, (3.0/0.98 mm), 5 stand tandem cold mill | | | | | |
|---|---|---|---|---|---|---|
| | | | 3 std. Breakage of roll at reduction ratio of 20% | | 3 std. Breakage of roll at reduction ratio of 30% | |
| | Roll dia. (mm) | L/D | Presence or absence of breakage | Determination of surface Brightness of product strip | Presence or absence of breakage | Brightness surface brightness of product strip |
| Example 4b | | | | | | |
| Comparative Example 4 | 135 | 11.1 | Present | — | Present | — |
| Conventional Example | 231 | 6.5 | None | D | None | D |

TABLE 8

| Content of Co in Sleeve material (wt %) | 6 | 8 | 10 | 12 | 17 | 20 | 23 | 25 | 30 | 40 | 50 | 55 | Conventional roll |
|---|---|---|---|---|---|---|---|---|---|---|---|---|---|
| Young's modulus (kgf/mm$^2$) | 62000 | 60000 | 58000 | 56000 | 52000 | 50000 | 48000 | 47000 | 44000 | 39000 | 35000 | 33000 | 21000 |
| Roll breakage | × | × | × | ○ | ○ | ○ | ○ | ○ | ○ | ○ | ○ | ○ | ○ |
| Brightness of product | Special A | Special A | Special A | Special A | A | A | B | B | B | C | C | D | D |

Symbols in roll breakage:
○ Not broken
× Broken

TABLE 9

| | Spec. of #5 stand in invented example Roll dia.: 285 mm | | | | |
|---|---|---|---|---|---|
| | Outermost layer | Intermediate layer 1 | Intermediate layer 2 | Shaft core | Remark |
| Invented example 6a | Material: WC-17Co<br>Young' modulus: 52000 kgf/mm$^2$<br>Wall thickness: 5 mm | Material: 40Co<br>Young' modulus: 39000 kgf/mm$^2$<br>Wall thickness: 4 mm | — | 5% Cr forged steel | |
| Invented example 6b | Material: 17Co<br>Young' modulus: 52000 kgf/mm$^2$<br>Wall thickness: 5 mm | Material: 30Co<br>Young' modulus: 44000 kgf/mm$^2$<br>Wall thickness: 4 mm | Material: 50Co<br>Young' modulus: 35000 kgf/mm$^2$<br>Wall thickness: 4 mm | 5% Cr forged steel | |
| Comparative Example 6a | Material: WC-17Co<br>Young' modulus: 52000 kgf/mm$^2$ | | | | monolithic roll |
| Comparative Example 6b | Material: WC-17% Co-28% Ni-7% Cr<br>Young' modulus: 33000 kgf/mm$^2$ | | | | monolithic roll |
| Comparative Example 6c | Material: WC-17Co<br>Young' modulus: 52000 kfg/mm$^2$<br>Wall thickness: 5 mm | — | — | 5% Cr forged steel | |
| Conventional Example | 5% Cr forged steel (Young' modulus: 21000 kfg/mm$^2$) | | | | Integral roll |

TABLE 10

Rolled material: SUS 430 Mother plate thickness/finish thickness; 4.0 mm/1.0 mm, tandem cold mill

| 5 stand breakage of roll at reduction ratio Evaluation of brightness of product strip & evaluation of roll strength | 20% | | 30% | | 40% | |
|---|---|---|---|---|---|---|
| | Evaluation of surface brightness of product strip | Presence or absence of breakage | Evaluation of surface brightness of product strip | Presence or absence of breakage | Evaluation of surface brightness of product strip | Presence or absence of breakage |
| Invented Example 6a | A | ○ | Special A | ○ | — | X |
| Invented Example 6b | A | ○ | Special A | ○ | Special A | ○ |
| Comparative Example 6a | A | ○ | Special A | ○ | Special A | ○ |
| Comparative Example 6b | C | ○ | C | ○ | B | ○ |
| Comparative Example 6c | A | ○ | — | X | — | X |
| Conventional Example | D | ○ | Failure | Occurrence of heat streak | Failure | Occurrence of heat streak |

X: Broken
○: Not broken

TABLE 11

| Roll dia. | 350 mm |
|---|---|
| Composition of sleeve made of WC alloy | WC-20wt%Co (Young' modulus: 50000 kgf/mm$^2$) |
| Thickness composition of sleeve made of WC alloy | 50 mm (per roll radius) |
| Shaft core material | SKD11 (Cold die steel) |

TABLE 12

| | Present invention | | Conventional Example | |
|---|---|---|---|---|
| Sample | A | B | C | D |
| Average roughness of steel sheet surface after tandem rolling, Ra($\mu$m) | 0.15 | 0.20 | 0.25 | 0.55 |
| Trimming amount (mm) | 7.5 | | 15.0 | |
| $I_{110}/I_0$ | 1.1 | | 0.8 | |
| $W_{17/50}$ (W/kg) | 0.87 | | 0.92 | |
| $B_8$(T) | 1.92 | | 1.90 | |

TABLE 13

| | Kind of steel | Tandem cold mill Stand No. | Roll dia. (mm) | Roll material | Roll breakage | Amount of iron removing on surface of strip after rolling (mg/mm$^2$) | Occurrence of heat streak after rolling | Occurrence of non-uniformity of steal strip surface after continues annealing |
|---|---|---|---|---|---|---|---|---|
| Invented example | Electro-magnetic steel sheet | 1<br>2<br>3<br>4 | 390<br>410<br>430<br>380 | Outer periphery: Tungsten carbide 80% + 20% Nickel (Wall thickness: 20 mm) Shaft core: Cold die steel | Not broken | 20 | None | None |
| Comparative Example | | 1<br>2<br>3<br>4 | 390<br>410<br>430<br>380 | Outer periphery: Tunsgen carbide 92% + 8% Nickel (Wall thickness: 10 mm) Shaft core: Cold die steel | Broken | 20 | None | None |
| Conventional Example | | 1<br>2<br>3<br>4 | 390<br>410<br>430<br>380 | Alloy steel | Not broken | 500 | Occurred | Occurred |

INDUSTRIAL APPLICABILITY

The composite sleeve roll of the present invention is accompanied by little strain and is comparatively long, and according to the fabrication method of the present invention, a composite sleeve roll in which no strain is caused in the material even when a sleeve made of hard alloys is subjected to heat treatment and which is large-sized, long, having high hardness and high Young's modulus and excellent in wear resistance can be fabricated with excellent operational performance.

Further, as has been explained, according to the present invention, there is provided a fit roll in which a sleeve member is made of WC—Co series hard alloys having Young's modulus of 35000 kgf/mm$^2$ or more and Co content of 12 though 50 weight % and is provided with a wall thickness of 3% or more of roll radius and therefore, a cold-rolled stainless steel strip or a bright finish steel strip having little edge drop and extremely excellent in surface brightness or a silicon steel strip having little surface roughness and excellent in magnetic properties can be rolled without causing breakage of roll.

Further, according to the present invention the ratio L/D of the length L of the barrel of the sleeve to the roll diameter D is determined to be in a range of 2 through 10 by which the strength against bending of the roll barrel can be promoted.

Further, according to the present invention the flattening deformation of the roll can be made to be a degree the same as that of an integral roll even in a fit roll and accordingly, the contact arc length of the roll bite is shortened, the rolling load is reduced and efficient rolling can be carried out.

Further, as has been explained, according to the present invention, by constituting a composite roll comprising the outermost layer having Young's modulus of 35000 kgf/mm$^2$ or more and the wall thickness of 3% or more of roll radius, the shaft core, and the intermediate layer having Young's modulus smaller than that of the outermost layer and larger than that of the shaft core, a cold-rolled stainless steel strip or a bright finish steel strip having little edge drop and extremely excellent in surface brightness or a silicon steel strip having little surface roughness and excellent in magnetic properties can be rolled without causing breakage of roll. Further, when the intermediate layer comprises 2 layers or more, by arranging the layers such that Young's modulus of the layer on the outer side is larger than Young's modulus of the layer on the inner side, danger of breaking roll can further be reduced.

Further, according to the present invention, the peripheral direction stress at the layer boundaries can be reduced by adjusting Young's modulus and accordingly, compared with a composite roll comprising only the shaft core and the roll outer layer, more reduction can be achieved and efficient rolling can be carried out.

Further, by carrying out cold rolling by using the rolls of the present invention, occurrence of wear powder can be restrained, nonuniformity is not caused on the surface of the steel strip after annealing and the steel strip with surface cleanness more excellent than that of the conventional strip can be achieved.

Further, the composite roll according to the present invention achieves excellent effect not only in cold rolling of a stainless steel strip, a silicon steel strip or a bright finish steel strip but also in rolling of an ordinary steel strip.

What is claimed is:

1. A method of fabricating a composite sleeve roll comprising the steps of:

forming a plurality of sleeve portions, each sleeve portion being formed by cold isostatic press molding comprising packing a mixture of WC powder and 12 to 50 wt % Co powder into a rubber mold in a space constituted by an inner cylinder and an outer cylinder;

subjecting each of the plurality of sleeve portions to preparatory sintering;

setting the plurality of sleeve portions to overlap them in a state where central axes of faces intersecting with the central axes are aligned;

canning the aligned plurality of sleeve portions;

integrating the aligned plurality of sleeve portions by hot isostatic press molding to form an integrated sleeve;

inserting, fitting and fixing a shaft portion to a hollow portion of the integrated sleeve; and wherein the preparatory sintering is conducted in a vacuum furnace at a temperature of 550 to 800° C. for 1 to 3 hours in which the central axes of the sleeve portions are in an approximately horizontal position.

2. The method of fabricating a composite sleeve roll according to claim 1, wherein, before the step of hot isostatic press molding, introducing a small amount of hydrogen into the vacuum furnace, to maintain the atmosphere at $10^{-3}$ to $10^{-5}$ mmHg at 1000 to 1200° C. for 0.5 to 2 hours and subsequently at 1200 to 13501° C. for 1 to 3 hours.

3. The method of fabricating a composite sleeve roll according to claim 1, further comprising, before the step of hot isostatic press molding, coating the joining surfaces with a binder.

4. The method of fabricating a composite sleeve roll according to claim 3, wherein the binder is at least one member selected from the group consisting of Co, Ni and Cr.

* * * * *